US007392740B2

(12) United States Patent
Baintner et al.

(10) Patent No.: US 7,392,740 B2
(45) Date of Patent: Jul. 1, 2008

(54) WEB FED ROTARY PRINTING UNIT

(75) Inventors: Alfons Baintner, Aystetten (DE); Max Eder, Mering (DE)

(73) Assignee: MAN Roland Druckmachinen AG, Offenbach (DE)

( * ) Notice: Subject to any disclaimer, the term of this patent is extended or adjusted under 35 U.S.C. 154(b) by 4 days.

(21) Appl. No.: 11/004,068

(22) Filed: Dec. 3, 2004

(65) Prior Publication Data

US 2005/0139102 A1 Jun. 30, 2005

(30) Foreign Application Priority Data

Dec. 5, 2003 (DE) ..... 103 57 006
Jan. 22, 2004 (DE) ..... 10 2004 003 338

(51) Int. Cl.
*B41F 5/16* (2006.01)

(52) U.S. Cl. ..... 101/177; 101/179

(58) Field of Classification Search ..... 101/136–145, 101/177–185, 216–220
See application file for complete search history.

(56) References Cited

U.S. PATENT DOCUMENTS

| | | | | | |
|---|---|---|---|---|---|
| 4,007,683 | A * | 2/1977 | Dickerson | ..... | 101/363 |
| 4,363,270 | A * | 12/1982 | Ury et al. | ..... | 101/180 |
| 4,394,835 | A * | 7/1983 | Gertsch et al. | ..... | 101/177 |
| 5,377,589 | A * | 1/1995 | Kruger et al. | ..... | 101/248 |
| 5,570,633 | A * | 11/1996 | Schultz et al. | ..... | 101/182 |
| 5,970,870 | A * | 10/1999 | Shiba et al. | ..... | 101/137 |
| 6,334,389 | B1 * | 1/2002 | Fischer | ..... | 101/216 |
| 6,745,688 | B1 * | 6/2004 | Lemelin et al. | ..... | 101/138 |
| 7,114,439 | B2 * | 10/2006 | Gerner et al. | ..... | 101/217 |
| 2001/0017087 | A1 * | 8/2001 | Schneider et al. | ..... | 101/216 |

FOREIGN PATENT DOCUMENTS

| | | | |
|---|---|---|---|
| DE | 432854 | C | 8/1926 |
| DE | 2637795 | A1 | 2/1978 |
| DE | 0459098 | A1 | 12/1991 |
| DE | 9117008.7 | U1 | 8/1993 |
| DE | 19732330 | A1 | 2/1999 |
| DE | 19951157 | A1 | 5/2001 |
| DE | 10046376 | A1 | 4/2002 |

* cited by examiner

*Primary Examiner*—Anthony H. Nguyen
(74) *Attorney, Agent, or Firm*—Leydig, Voit & Mayer, Ltd.

(57) ABSTRACT

A web-fed rotary printing unit having a plurality of printing mechanisms is provided. Each printing mechanism includes a form cylinder (1, 5, 16-18, 27-30), a transfer cylinder (2, 6, 3, 7, 12-15, 22-25) and an impression cylinder (3, 7, 11, 26). The component costs associated with the drive motors can be reduced by providing a drive motor (4, 8, 9, 21, 41, 42, 55) that has a drive connection to the other cylinders via the impression cylinder.

22 Claims, 10 Drawing Sheets

WEB FED ROTARY PRINTING UNIT

FIELD OF THE INVENTION

The invention relates generally to a web-fed rotary printing unit having a plurality of printing mechanisms.

BACKGROUND OF THE INVENTION

Web-fed rotary printing units having a plurality of printing mechanisms are known. Each printing mechanism generally includes a form cylinder, a transfer cylinder and an impression cylinder. In such printing units, each printing mechanism includes at least one dedicated drive motor. Accordingly, for example, a printing unit including four printing mechanisms includes a plurality of drive motors.

BRIEF SUMMARY OF THE INVENTION

In view of the foregoing, an object of the invention is to reduce the manufacturing and component costs associated with the drive motors. According to the invention, this is achieved by providing a drive motor that has a drive connection to the other cylinders via the impression cylinder. This results not only in a reduction in the manufacturing and component costs but also reduces the potential that the drives will fail. According to a further aspect of the invention, two printing mechanisms having a common driven impression cylinder are provided. This arrangement allows the two printing mechanisms to be operated with only one drive motor.

According to a further aspect of the invention, two printing mechanisms each having a driven impression cylinder are arranged with impression cylinders facing each other in order to form a 10-cylinder printing unit. In such a printing unit, each impression cylinder can to be assigned a drive motor or alternatively the two impression cylinders can have a common drive motor. According to another aspect of the invention, three or four printing mechanisms are arranged around a commonly driven impression cylinder. Only one drive motor is necessary as well in this embodiment.

A further embodiment includes two printing mechanisms each having an impression cylinder driven by a first drive motor. In this embodiment, it is possible for at least one transfer cylinder with a form cylinder connected downstream therefrom, which can be driven by means of a second drive motor, to be set against the impression cylinder. The connecting gears of the cylinders of the two printing mechanisms are arranged in one plane and the connecting gears of the other cylinders are arranged in a second plane parallel thereto.

According to another aspect of the invention, the drive motor is fitted to the shaft of the impression cylinder. This minimizes the component costs associated with the driving of the printing mechanism. Alternatively, a drive train can be arranged between the drive motor and the impression cylinder. With such an arrangement, the drive motor can be installed in a relatively wide variety of locations and the rotational speed of the motor can differ from the rotational speed of the impression cylinder.

Advantageously, an isolating clutch can be provided between each impression cylinder and at least one component driven by the respective impression cylinder. This arrangement allows the other cylinders, and, if necessary, an inking and/or damping unit, to be disconnected from the drive motor for changeover purposes. An auxiliary motor can then preferably drive the disconnected components. Since the auxiliary motor has to drive the disconnected components at a lower rotational speed for the purpose of changeover, the auxiliary motor can have low output and a low-cost design.

A further isolating clutch can expediently be provided between the auxiliary motor and the subassembly that can be disconnected. Therefore, the auxiliary motor does not have to co-rotate during operation. If the auxiliary motor is designed in such a way that it can co-rotate during the operation of the press, such an isolating clutch is rendered unnecessary.

The present invention has particular application in web-fed rotary offset presses.

DETAILED DESCRIPTION OF THE INVENTION

Figure 1:
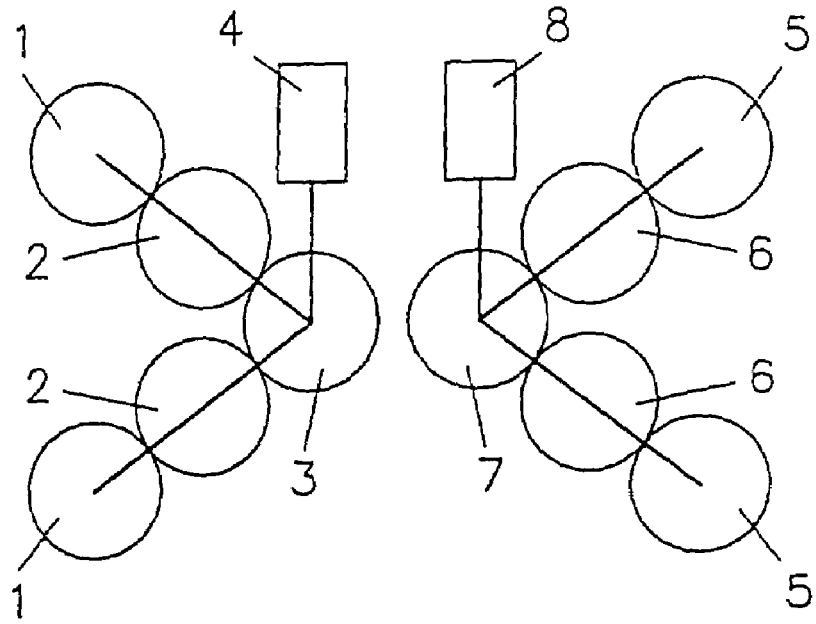
FIG. 1 is a schematic drawing of an exemplary printing unit including multiple printing mechanisms and having a drive arrangement according to the present invention.

Referring now to the drawings, FIG. 1 illustrates (on the left-hand side) two printing mechanisms each of which includes a form cylinder 1 and a transfer cylinder 2. The transfer cylinders 2 bear on a common impression cylinder 3. The impression cylinder 3 can be driven by a drive motor 4. The drive motor 4 can, for example, be rigidly fixed to the shaft of the transfer cylinder or connected to the transfer cylinder shaft via a clutch. The form and transfer cylinders 1 and 2 are driven by the impression cylinder 1 in a known manner by means of connecting gears.

As further shown in FIG. 1, the first two printing mechanisms can be extended by means of two additional printing mechanisms arranged in mirror-image fashion. Each additional printing mechanism has two form cylinders 5 and two transfer cylinders 6, which bear on a common impression cylinder 7 and are driven by a drive motor 8. Thus, a 10-cylinder printing unit is formed in which the two impression cylinders 3, 7 face each other.

Figure 2:
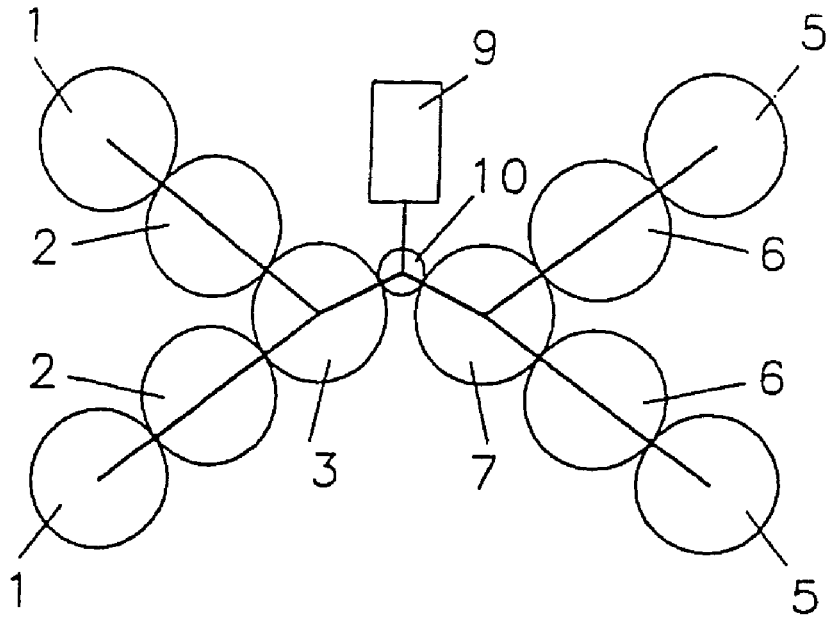
FIG. 2 is a schematic drawing of a further embodiment of a printing unit including multiple printing mechanisms and having a drive arrangement according to the present invention.

FIG. 2 illustrates a further simplification of the drive of this 10-cylinder printing unit. In the arrangement shown in FIG. 2, only one drive motor 9 is provided. The drive motor 9 has simultaneous drive connection to both the impression cylinders 3, 7 via a gear train 10 (shown schematically). The gear train 10 can comprises a plurality of inter-engaging gears or a chain drive. If only 3-color printing is desired, then one transfer cylinder, for example transfer cylinder 15, and the associated form cylinder 19 can be eliminated.

Figure 3:
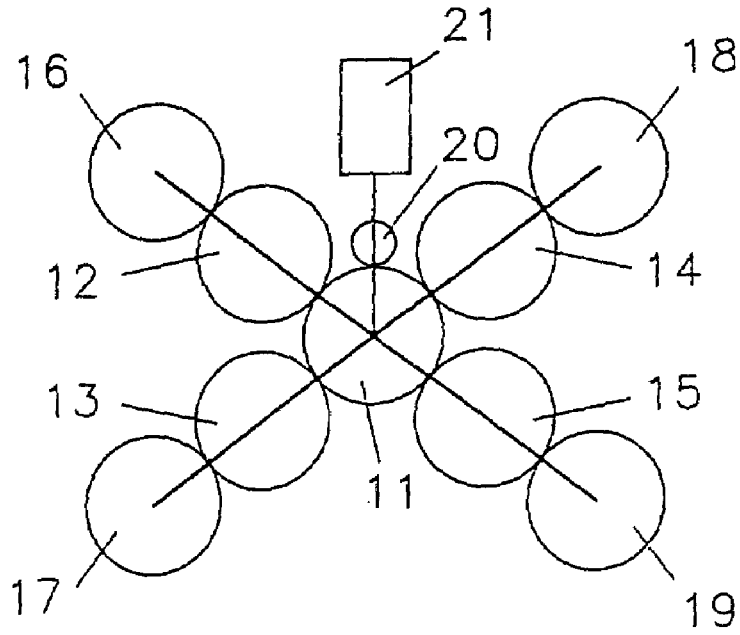
FIG. 3 is a schematic drawing of another embodiment of a printing unit including multiple printing mechanisms and having a drive arrangement according to the present invention.

FIG. 3 discloses a 9-cylinder printing unit. In this embodiment, a central impression cylinder 11 is provided, on which four transfer cylinders 12-15 bear. Each of the transfer cylinders 12-14 is, in turn, in contact with a form cylinder 16-19. The impression cylinder 11 is connected to a drive motor 21 via a gear train 20 (shown schematically).

Figure 5:
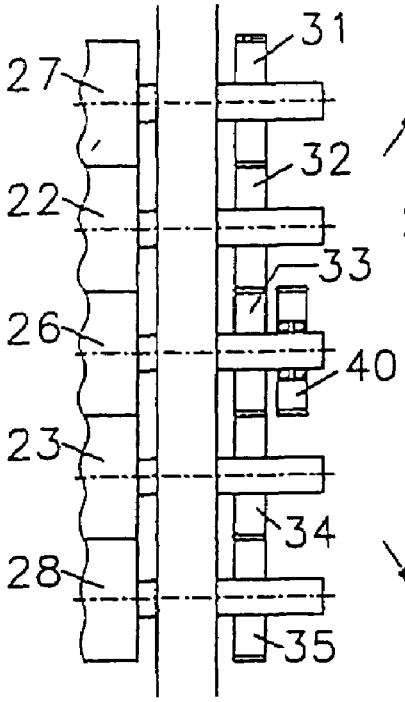
FIG. 5 is a cross-sectional view of the printing unit of FIG. 4 taken along the line V-V in FIG. 4.
Figure 4:
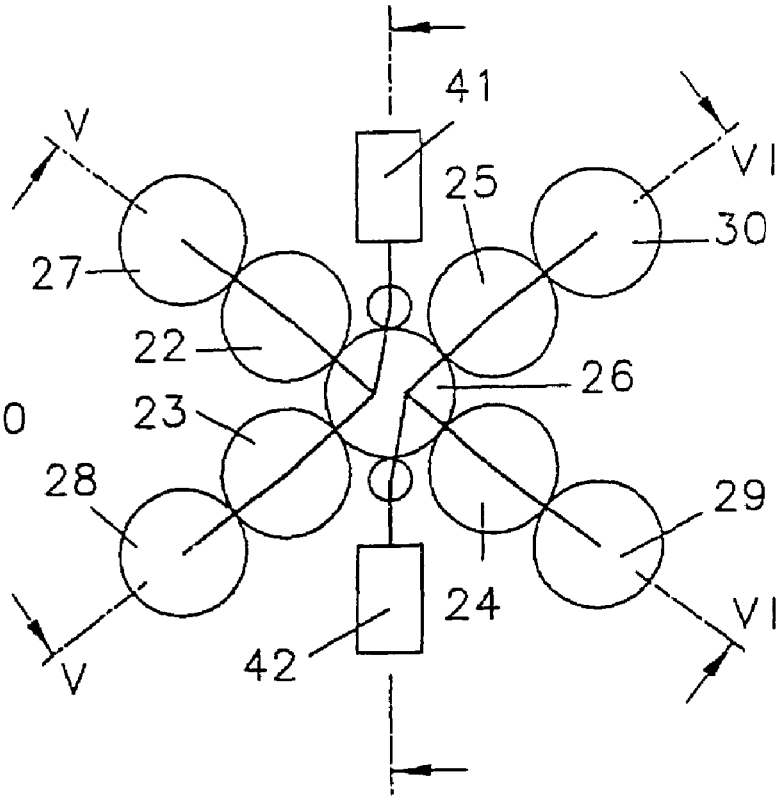
FIG. 4 is a schematic drawing of another embodiment of a printing unit including multiple printing mechanisms and having a drive arrangement according to the present invention.
Figure 6:
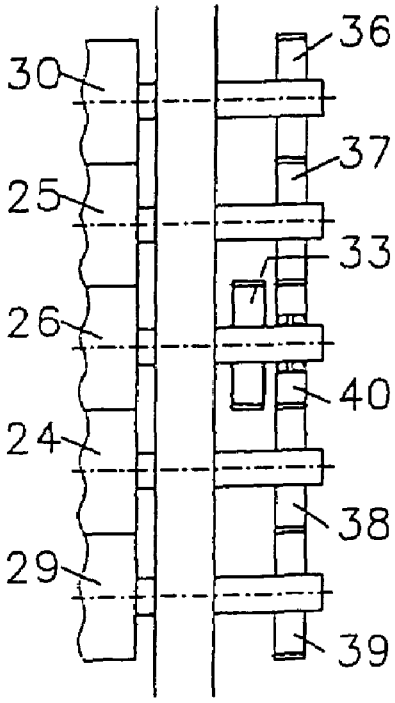
FIG. 6 is a cross-sectional view of the printing unit of FIG. 4 taken along the line VI-VI in FIG. 4.

A variant of a drive for a 9-cylinder printing unit is shown in FIG. 4. In this embodiment, four transfer cylinders 22-25 again are in contact with a common impression cylinder 26. A form cylinder 27-30 bears on each of the transfer cylinders 22-25. As can be seen in FIG. 5 (a cross-sectional view taken along the line V-V in FIG. 4), a connecting gear 31-35 can be fitted firmly to the shaft of each cylinder 27, 22, 26, 23 and 28. These connecting gears lie in a common plane and mesh with one another. FIG. 6 (a cross-sectional view taken along the line VI-VI in FIG. 4) shows that a connecting gear 36-39 is fitted firmly to each of the cylinders 30, 25, 24, 29. These gears are arranged in a plane that is offset laterally relative to the connecting gears 31-35. In this case, the connecting gears 37, 38 mesh with a further connecting gear 40 arranged loosely on the shaft of the impression cylinder 26.

Figure 7:
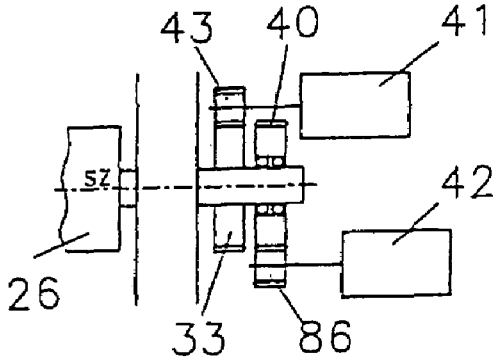
FIG. 7 is a schematic view of a portion of the drive arrangement of the printing unit of FIG. 4.

As shown in FIG. 7, a drive motor 41 drives the connecting gear 33, which is fitted firmly to the shaft of the impression cylinder 26 via a pinion 43. A further drive motor 42 drives the connecting gear 40 arranged loosely on the shaft of the impression cylinder 26 via a pinion 86. With this arrangement, the two printing mechanisms with the transfer cylinders 22, 23 are driven by means of the drive motor 41 while the cylinders 24, 29, 25, 30 are stopped. If the drive motor 42 is switched on, all the printing mechanisms of this printing unit are able to print.

Figure 8:
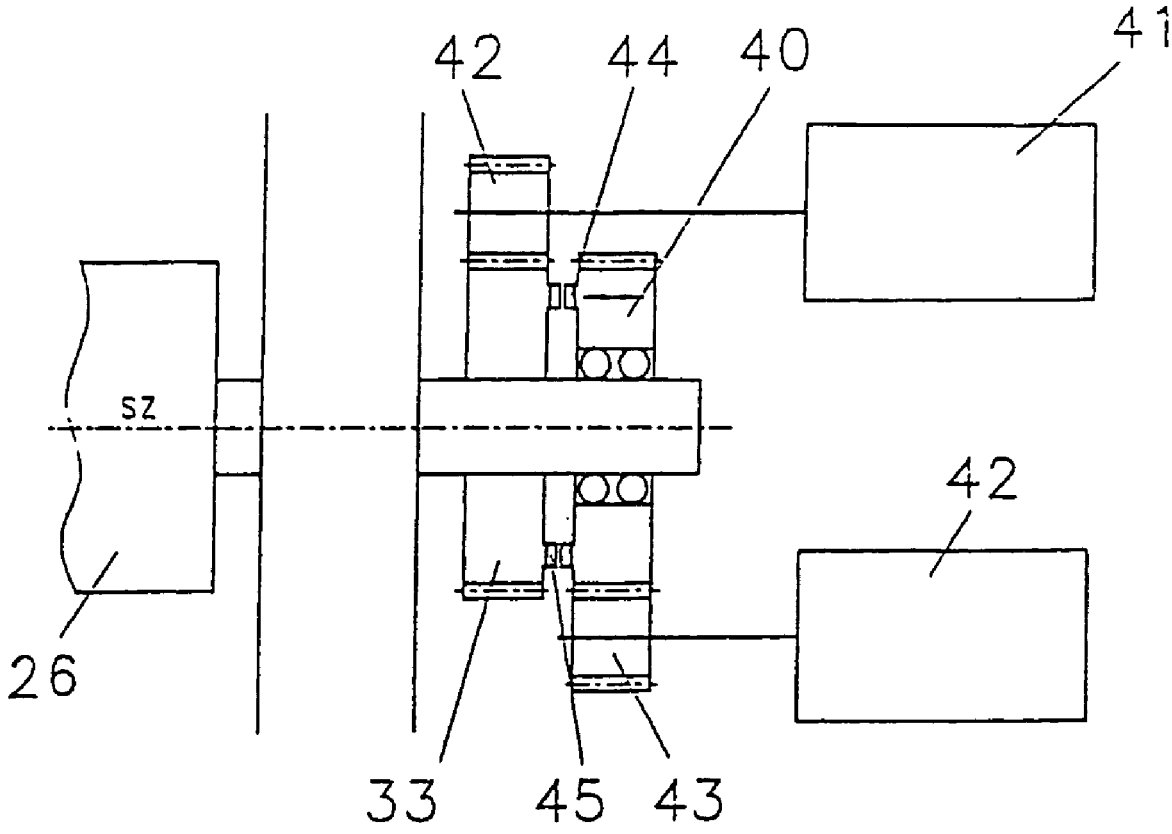
FIG. 8 is a schematic view of a further embodiment of the drive arrangement of the printing unit of FIG. 4.

In a further refinement of this arrangement, as shown in FIG. 8, the connecting gear 40 can be mounted such that it can be displaced axially. The connecting gear 40 further has coupling elements 44 that, as a result of the axial displacement, come into engagement with matching coupling elements 45 on the connecting gear 33 on the shaft of the impression cylinder 26. In this way, it is possible to use both drive motors 41, 42 together to drive the 9-cylinder printing unit. Furthermore, an isolating clutch can be provided between the drive motor 41 and the pinion 42 and/or the drive motor 42 and the pinion 43.

Figure 9:
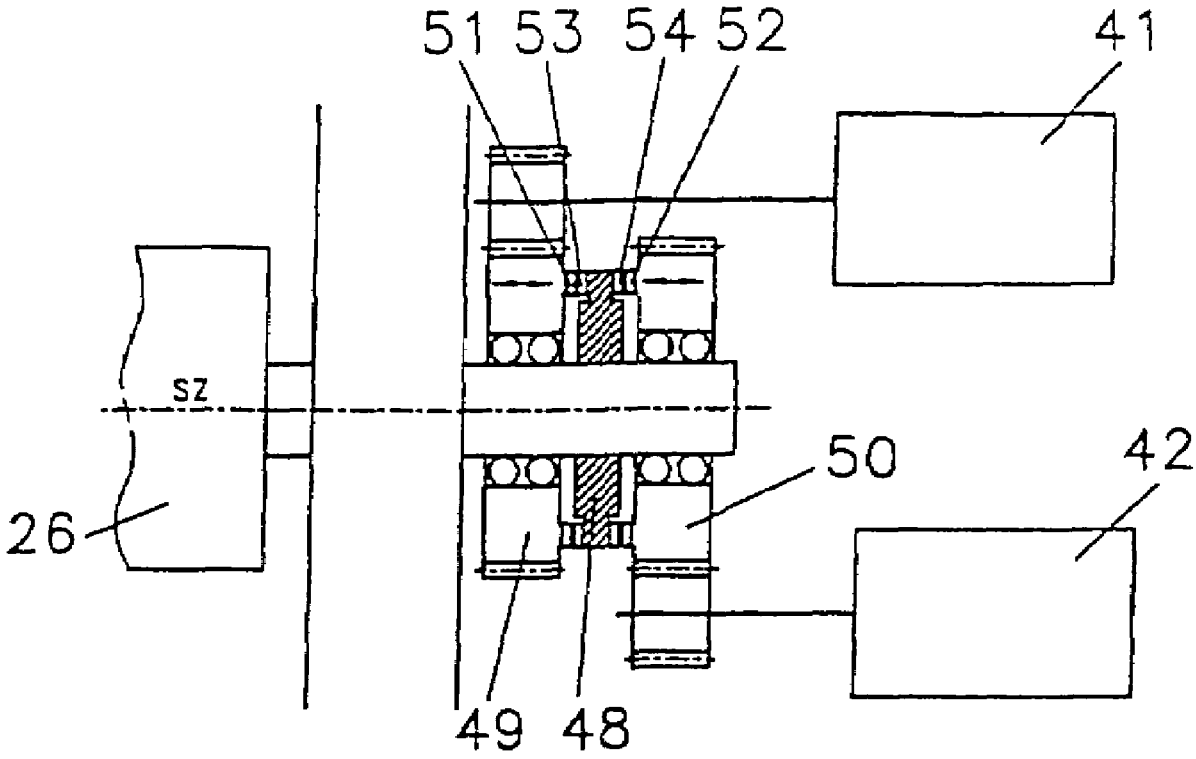
FIG. 9 is a schematic view of a further embodiment of the drive arrangement shown in FIG. 8.

A variant of the arrangement of FIG. 8 is shown in FIG. 9. In the embodiment shown in FIG. 9, a coupling disc 48 is attached firmly to the shaft of the impression cylinder 26. On each side of the coupling disc 48, a connecting gear 49, 50 is placed on the shaft of the impression cylinder 26 such that it can rotate freely and can be displaced axially. In this case, the connecting gear 49 again meshes with the connecting gears 32, 34, and the connecting gear 50 meshes with the connecting gears 37, 38. On the side of the connecting gears 49, 50 facing the coupling disc 48, the connecting gears 49, 50 have coupling elements 51, 52 that optionally can be brought into engagement with matching coupling elements 53, 54 belonging to the coupling disc 48 by means of axial displacement of the gears 49, 50. In this way, it is possible to both of drive the cylinders 27, 22, 26, 23, 28 and the cylinders 29, 24, 26, 25 and 30 separately and also all the connecting gears jointly. With this arrangement, the cylinders 25 and 30 also can be left out if required.

Figure 10:
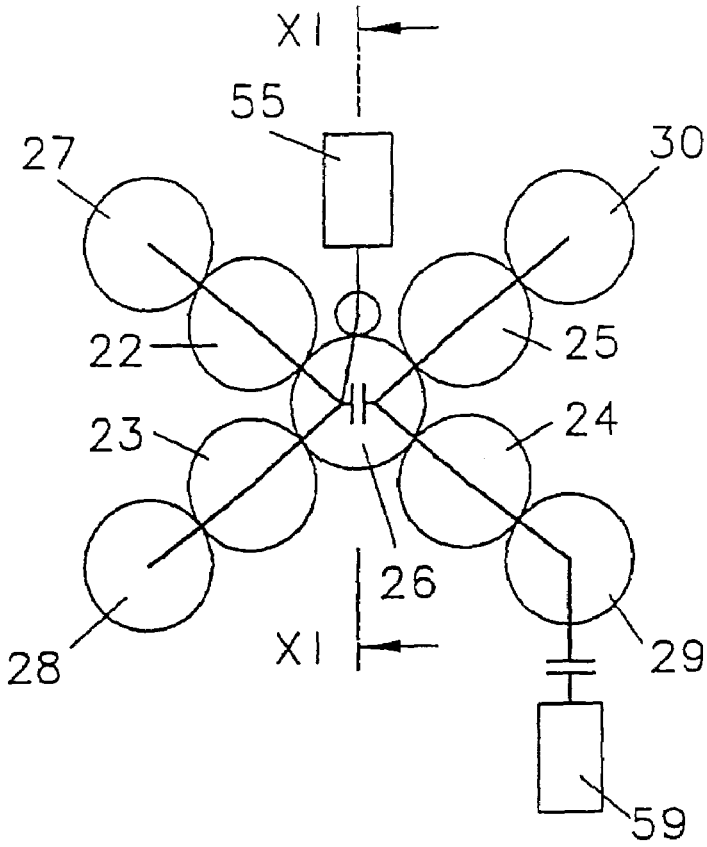
FIG. 10 is a schematic view of another embodiment of a printing unit including multiple printing mechanisms and having a drive arrangement according to the present invention.
Figure 11:
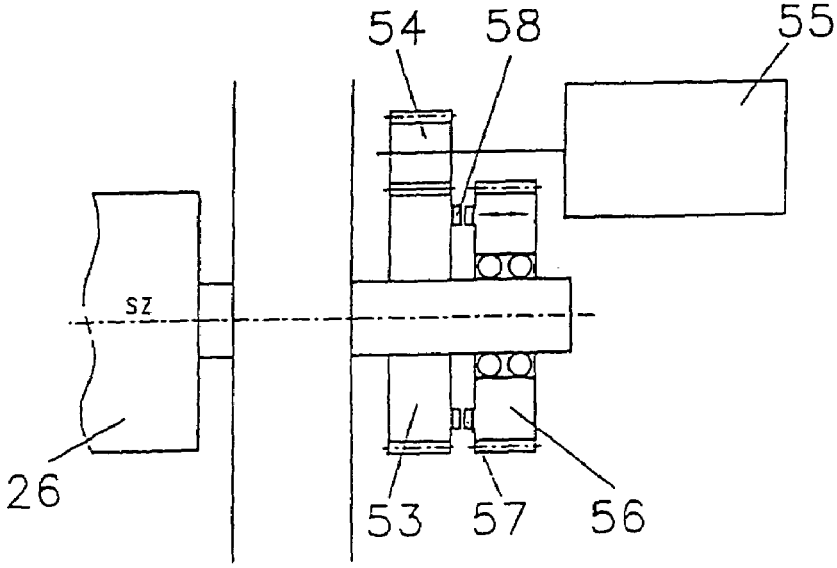
FIG. 11 is a cross-sectional view of the printing unit of FIG. 10 taken along the line XI-XI in FIG. 10.

FIGS. 10 and 11 illustrate a further variant of the drive of a 9-cylinder printing unit, in which the connecting gears are arranged in two planes, similar to what is shown in FIGS. 5 and 6. In the embodiment shown in FIGS. 10 and 11, a connecting gear 53, which in turn meshes with the connecting gears 32, 34, is attached firmly to the shaft of the impression cylinder 26. A drive motor 55 drives the connecting gear 53 via a pinion 54. A further connecting gear 56, which again supports coupling elements 57, is placed on the shaft of the impression cylinder 26 such that it can rotate freely and be displaced axially. The coupling elements 57 can be brought into engagement with matching coupling elements 58 on the connecting gear 53 by means of axial displacement of the connecting gear 56. The connecting gear 56, in turn, engages with the connecting gears 37, 38 as shown in FIG. 6. In the position of the components that is shown in FIG. 11, the drive motor 55 drives the cylinders 27, 22, 26, 23 and 28. In order to be able to rotate the cylinders 29, 24, 25 and 30 for changeover work, an auxiliary motor 59 is provided, which can be brought into a drive connection with the connecting gear 39 of the form cylinder 29 via an isolating clutch 60. The cylinders 24, 25 and 30 can be rotated by the auxiliary motor 59 via the gears 38, 56, 37 and 36. If, as a result of axial displacement of the connecting gear 56, the clutch and matching coupling elements 57, 58 interengage, then the drive motor 55 drives all nine cylinders of the printing unit.

Further details of the printing units described can be understood from the following description.

Figure 12:
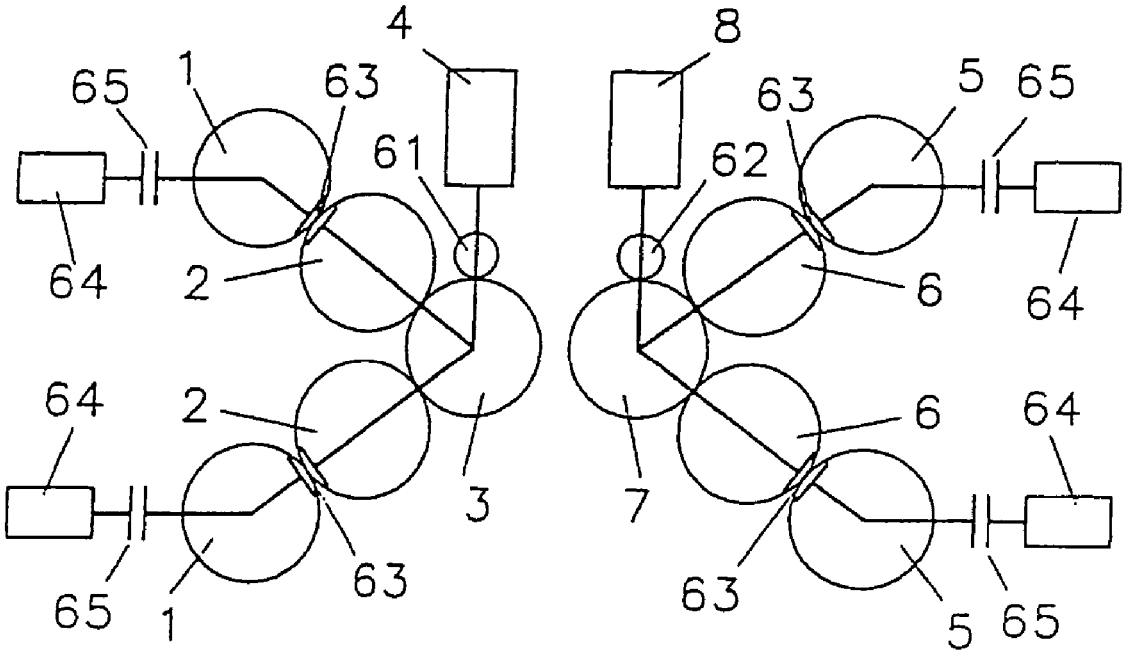
FIG. 12 is a schematic view of another embodiment of a printing unit including multiple printing mechanisms and having a drive arrangement according to the present invention that is based on the embodiment of FIG. 1.

The embodiment illustrated in FIG. 12 is based on the basic structure shown in FIG. 1. However, with the FIG. 12 embodiment, each of the drive motors 4, 8 has a drive connection to the impression cylinders 1, 2 via a gear train 61, 62. In addition, an isolating clutch 63 that interrupts the drive connection between the impression cylinders 1, 2 is provided between the transfer cylinders 2, 6 and the respectively associated form cylinders 1, 5. In this case, each of the form cylinders 1, 5 can be driven by an auxiliary motor 64 in order to permit the form cylinders to be changed over. In the illustrated embodiment, isolating clutches 65 are also provided between each auxiliary motor 64 and the associated form cylinder 1 and 5. Therefore, the auxiliary motors 64 can be switched off during printing operations. If the auxiliary motors 64 are designed in such a way that they can revolve with the cylinders while idling, it is possible to dispense with the isolating clutches 65.

Figure 13:
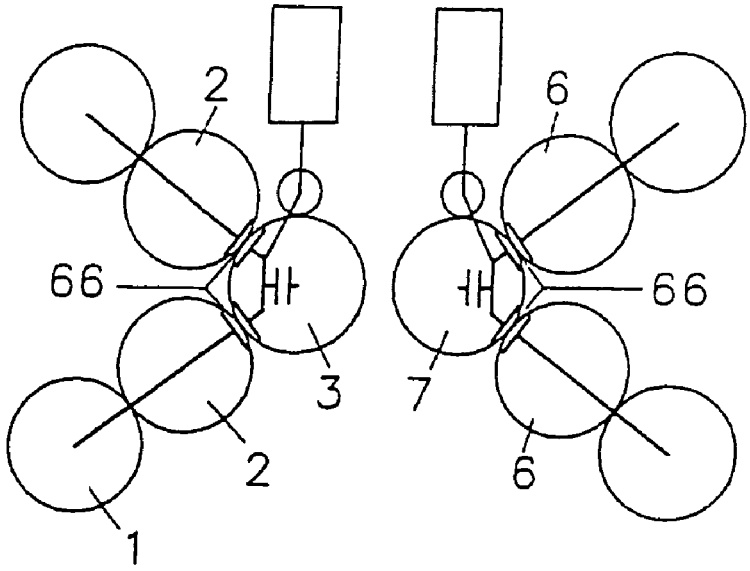
FIG. 13 is a schematic view of another embodiment of a printing unit including multiple printing mechanisms and having a drive arrangement according to the present invention that is based on the embodiment of FIG. 1.

The embodiment according to FIG. 13, which is again based on the basic arrangement according to FIG. 1, illustrates that isolating clutches 66 can also be arranged between the impression cylinders 3, 7 and the transfer cylinders 2, 6. This arrangement permits a transfer cylinder (for example transfer cylinder 2) with the associated form cylinder 1 to be disconnected for the purpose of changeover, while the press is printing three colors with the remaining transfer cylinders 3.

Figure 14:
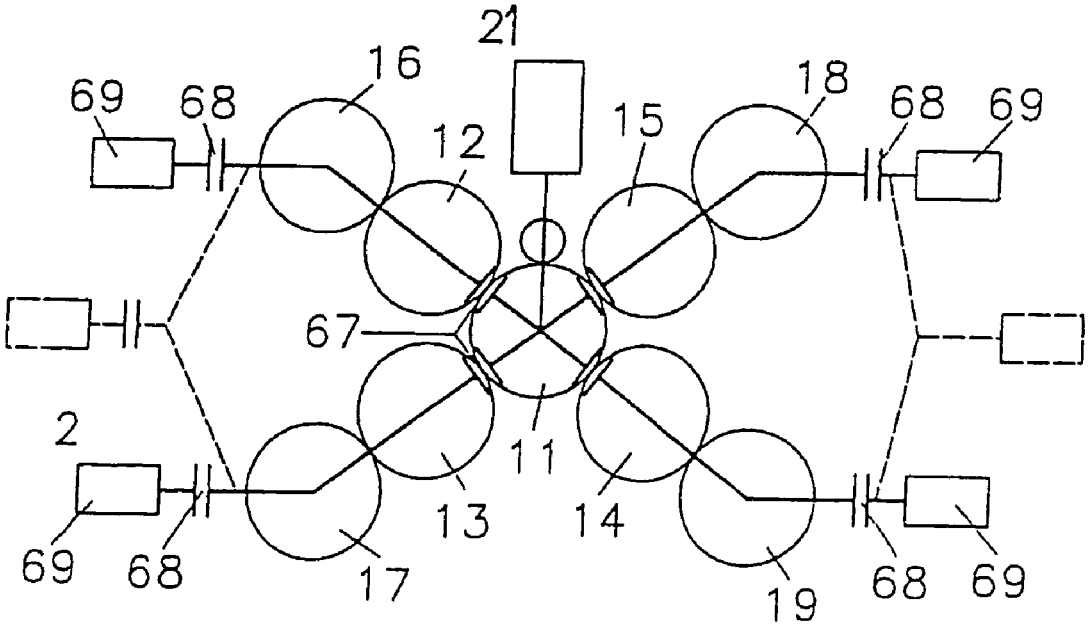
FIG. 14 is a schematic view of another embodiment of a printing unit including multiple printing mechanisms and having a drive arrangement according to the present invention that is based on the embodiment of FIG. 2.

The arrangement shown in FIG. 14 is based on the basic arrangement shown in FIG. 2. In the FIG. 14 embodiment, isolating clutches 67 are arranged between the single impression cylinder 11 and the transfer cylinders 12 to 15. The isolating clutches 67 allow the drive connection to be interrupted from the impression cylinder 11, which is driven by the drive motor 21. Additionally, each form cylinder 16 to 19 can be driven by means of an auxiliary motor 16 and via an isolating clutch 68 for the purpose of changeover. Again, in this case, the isolating clutches 68 can be left out if the auxiliary motors 69 are designed in such a way that they can co-rotate during operation of the press.

Figure 15:
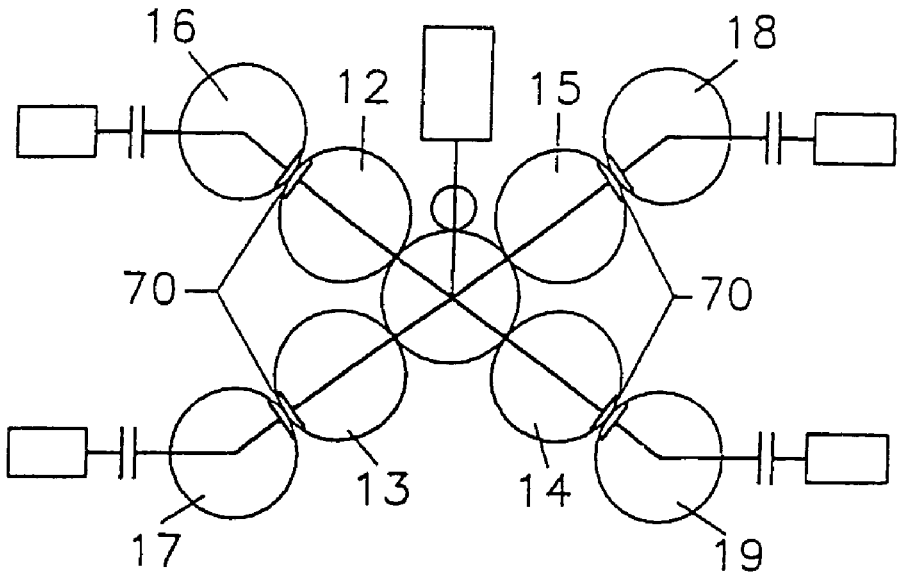
FIG. 15 is a schematic view of another embodiment of a printing unit including multiple printing mechanisms and having a drive arrangement according to the present invention that is a variant of the embodiment of FIG. 14.

As shown in FIG. 15, the arrangement according to FIG. 14 can be modified such that isolating clutches 29 can be arranged between the transfer cylinders 12 to 15 and the form cylinders 16 to 19. The remainder of the structure shown in FIG. 15 is the same as the arrangement of FIG. 14.

Figure 16:
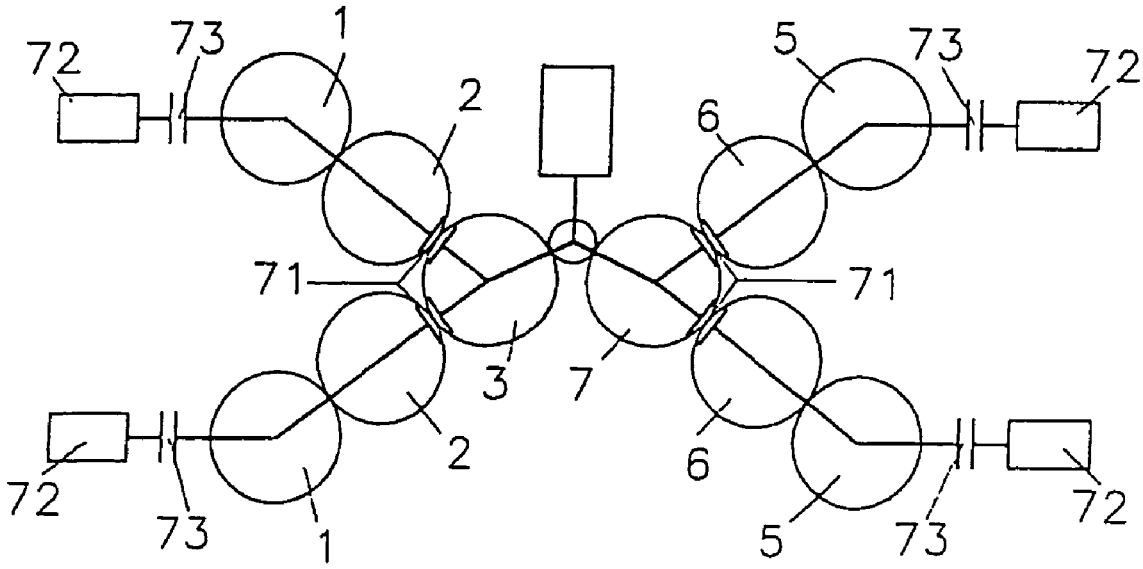
FIG. 16 is a schematic view of another embodiment of a printing unit including multiple printing mechanisms and having a drive arrangement according to the present invention that is based on the embodiment of FIG. 3.

The embodiment of FIG. 16 is based on the basic arrangement of FIG. 3. Specifically, in addition to what is provided in the FIG. 3 arrangement, isolating clutches 71 are provided between the impression cylinders 3, 7 and the transfer cylinders 2, 6. For the purpose of changeover, each form cylinder 1, 5 can be driven by an auxiliary motor 72. In this case, isolating clutches 73 are again provided between the auxiliary motors 72 and the forme cylinders 1, 5. The isolating clutches 73 again can be dispensed with if the auxiliary motors 72 are designed in such a way that they can co-rotate during printing operation.

Figure 17:
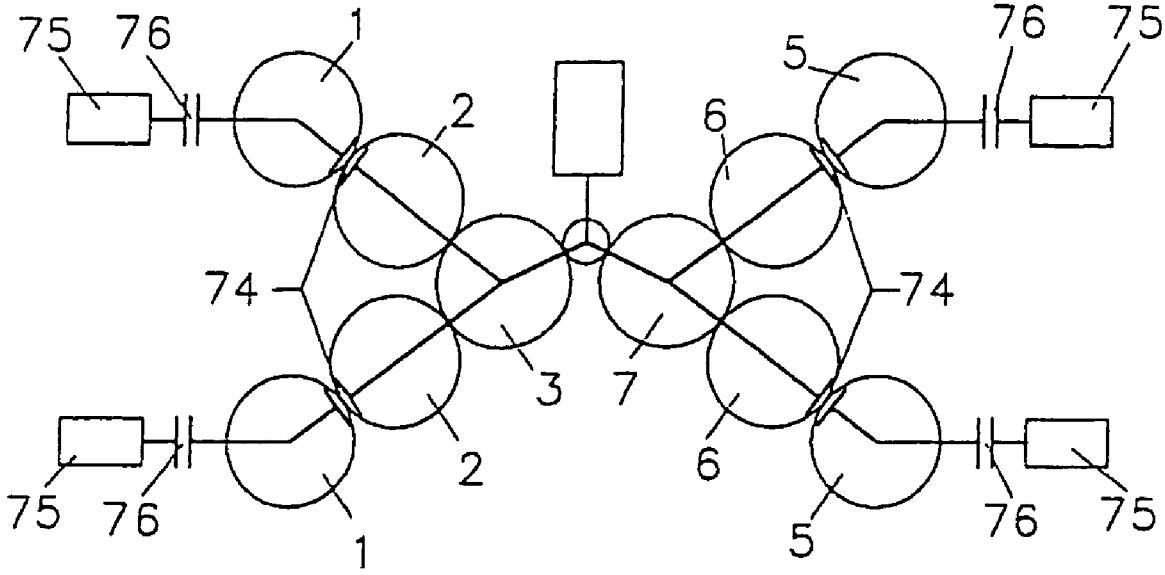
FIG. 17 is a schematic view of another embodiment of a printing unit including multiple printing mechanisms and having a drive arrangement according to the present invention that is based on the embodiment of FIG. 2.

The printing mechanism according to FIG. 17 is likewise based on the arrangement according to FIG. 2. In the FIG. 17 embodiment, isolating clutches 74 are arranged between the transfer cylinders 2, 6 and the form cylinders 1, 5. Each form cylinder 1, 5 can be driven by an auxiliary motor 75 with the interposition of an isolating clutch 76. If desired, additional isolating clutches can be provided between the impression cylinders 3 and 7 and the transfer cylinders 2, 6.

Figure 18:
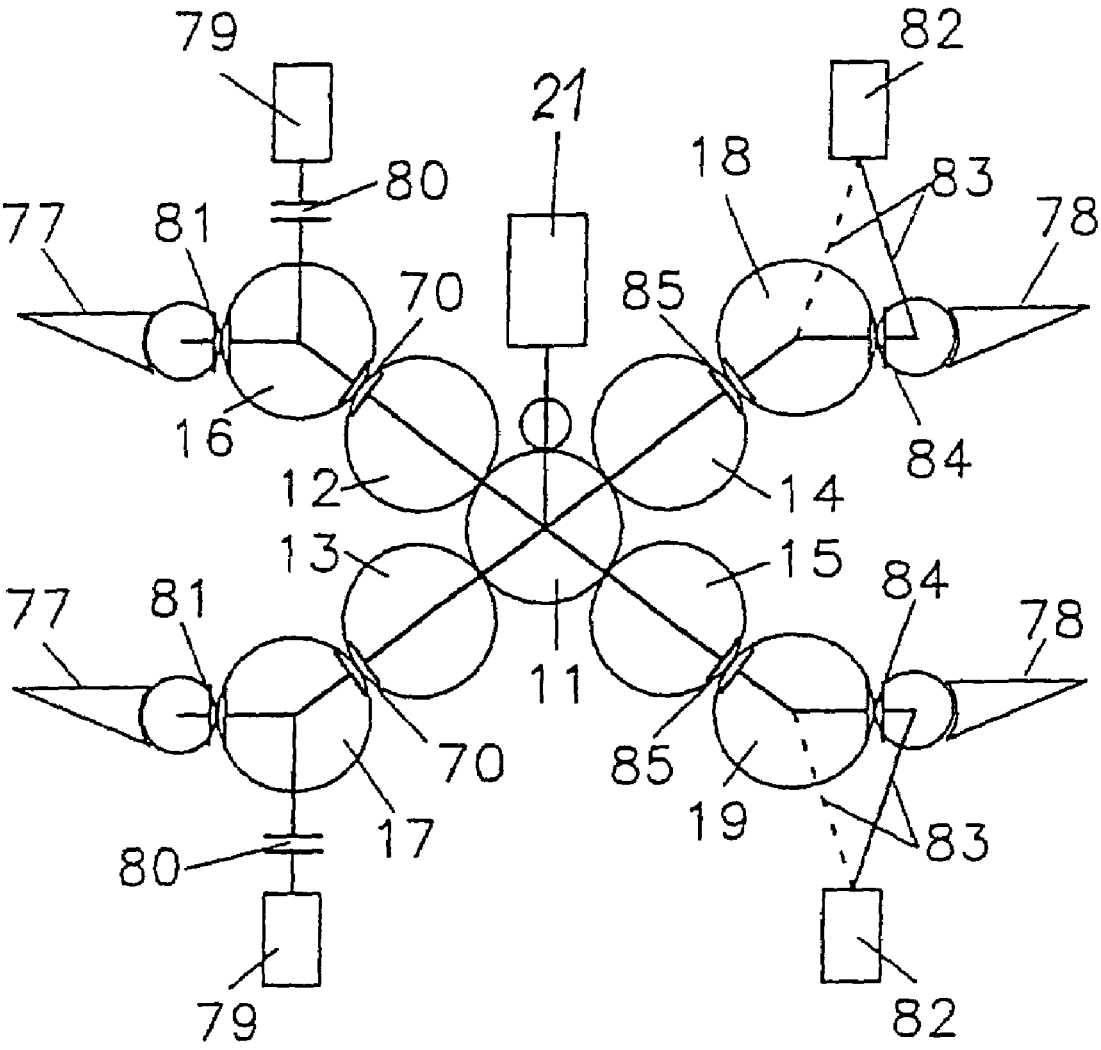
FIG. 18 is a schematic view of another embodiment of a printing unit including multiple printing mechanisms and having a drive arrangement according to the present invention that is based on the embodiment of FIG. 3.

FIG. 18, which is based on the basic structure of FIG. 3, shows two variants of the auxiliary drive of inking and/or damping units 77, 78. In the case of the arrangement illustrated in the left-hand half of the drawing, an auxiliary motor 79 can be connected to each form cylinder 16, 17 via an isolating clutch 80. The inking and/or damping unit 36 can be coupled to each form cylinder 16, 17 via a further isolating clutch 81 in order to drive the inking and/or damping unit 36. Alternatively, the inking and/or damping unit can be connected to the main drive via the transfer cylinder 12, 13 through an isolating clutch 70. In this configuration, for changeover work, it is possible to drive the associated inking and/or damping unit 77 and the form cylinder 16 or 17, or only the form cylinder, via each auxiliary motor 79. On the other hand, when the isolating clutches 70, 81 are engaged, the inking and/or damping unit 36 is driven by the form cylinder 12 or 13 during operation of the machine.

In the arrangement illustrated on the right side of FIG. 18, auxiliary motors 82 optionally can be brought into a drive connection with the form cylinder 18, 19 or the inking and/or damping unit 78 in each case via a changeover mechanism 83. Each form cylinder 18, 19 can be disconnected from or connected to the respectively associated transfer cylinder 14, 15 by the isolating clutch 70. A further isolating clutch 84 is expediently provided between each form cylinder 18, 19 and the inking and/or damping unit 78. This arrangement permits the inking and/or damping unit 78 to be rotated by the auxiliary motor 82 without a form cylinder 18, 19 being moved. A further isolating clutch 85 is also provided between the form cylinders 18, 19 and the transfer cylinder 14, 15.

Since the drive motors are generally position-controlled and, for this purpose, require a servomotor with a high-resolution transmitter, a converter, a controller, a switch cabinet and a feed unit, if the number of drive motors is minimized, a further reduction in the components costs results. As compared with web-fed rotary presses having a plurality of drive motors, the present invention has the further advantage that the overall motor power to be provided can be reduced, because the stress power no longer has to be taken into account.

In order to adjust the circumferential register, the relevant form cylinder is rotated. In the event that an isolating clutch between the impression cylinder and a cylinder that can be uncoupled from the impression cylinder is engaged, this rotation can be accomplished by, for example, displacing a transfer cylinder and/or a form cylinder axially with a rotational movement of the form cylinder being derived from this movement via an obliquely toothed gear that is fixed on the shaft of the displaceable cylinder. The rotational movement of the form cylinder can also be produced by an obliquely toothed gear being displaced axially on the shaft of the transfer cylinder or of the form cylinder. The obliquely toothed gear fixed on the shaft of the displaceable cylinder, or the axially displaceable obliquely toothed gear in this case, engages with a further obliquely toothed gear that is seated on an adjacent cylinder that is not affected by the circumferential register adjustment and maintains its position.

The adjustment of the circumferential register of a printing mechanism which has a mechanical drive connection to the impression cylinder can, however, also be done with the aid of the drive motor that drives the impression cylinder and/or possibly drive motors assigned to the further printing mechanisms. In such a case, the impression cylinder is rotated by the adjustment of the circumferential register. In the event that the isolating clutch between the impression cylinder and a cylinder that can be uncoupled from the impression cylinder is disengaged or relieved of load, which, for example, would be conceivable if a friction clutch were to be used, the form cylinder can be rotated by the further drive motor assigned to it for the adjustment of the circumferential register.

The circumferential register adjustment possibilities described above have particular application in web-fed rotary offset presses.

What is claimed is:

1. A web-fed rotary printing unit comprising:

a plurality of printing mechanisms, each printing mechanism including an impression cylinder and further cylinders comprising a form cylinder and a transfer cylinder;

wherein a first pair of the printing mechanisms share an impression cylinder having a common first drive motor, the common first drive motor including a first drive connection to one or more of the further cylinders of the first pair of printing mechanisms through the shared impression cylinder;

a third printing mechanism having at least one transfer cylinder and a form cylinder connected downstream of the transfer cylinder, the transfer cylinder and the form cylinder of the third printing mechanism being settable against the impression cylinder of the first pair of printing mechanisms and being driveable by a second drive motor;

wherein the first drive connection of the first drive motor of the impression cylinder of the first pair of printing mechanisms includes a first set of connecting gears fitted to shafts of further cylinders arranged in a first plane, the first set of connecting gears including a first connecting gear driveable by the common drive motor of the first pair of printing mechanisms that is fitted firmly to a shaft of the impression cylinder of the first pair of printing mechanisms;

wherein the third printing mechanism includes a second drive connection including a second set of connecting gears fitted to the shafts of the transfer cylinder and the form cylinder of the third printing mechanism, the second set of connecting gears being arranged in a second plane parallel to the first plane, the second set of connecting gears including a second connecting gear driveable by the second drive motor associated with the third printing mechanism that is placed on the shaft of the impression cylinder of the first pair of printing mechanisms such that the first and second connecting gears are coupleable to each other.

2. A web-fed rotary printing unit according to claim 1, further including a second pair of printing mechanisms that share an impression cylinder with the impression cylinder of the second pair of printing mechanisms and the impression cylinder of the first pair of printing mechanisms being arranged in mutual facing relation so as to for a 10-cylinder printing unit.

3. A web-fed rotary printing unit according to claim 2, the impression cylinder of the second pair of printing mechanisms has a second drive motor.

4. A web-fed rotary printing unit according to claim 2, wherein the common drive motor drives the impression cylinder of the first pair of printing mechanisms and the second pair of printing mechanisms.

5. A web-fed rotary printing unit according to claim 1, wherein a third printing mechanism shares the commonly driven impression cylinder with the first pair of printing mechanisms.

6. A web-fed rotary printing unit according to claim 1, wherein a third printing mechanism and a fourth printing mechanism share the commonly driven impression cylinder with the first pair of printing mechanisms.

7. A web-fed rotary printing unit according to claim 1, wherein the drive connection includes interengaging connecting gears fitted to shafts of further cylinders.

8. A web-fed rotary printing unit according to claim 1, wherein the first and second connecting gears on the shaft of the impression cylinder of the first pair of printing mechanisms include coupling elements, the coupling elements of the first and second connecting gears being arranged on mutually facing sides of the first and second connecting gears, and wherein one of the first and second connecting gears is mounted such that it is displaceable axially in order to produce coupling engagement between the first and second connecting gears.

9. A web-fed rotary printing unit according to claim 8, wherein a coupling disc is fitted firmly to the shaft of the impression cylinder of the first pair of printing mechanisms, the first and second connecting gears being engageable with the coupling disc and being mounted such that each of the first and second connecting gears are displaceable axially in to engagement with the coupling disc.

10. A web-fed rotary printing unit according to claim 1, wherein the common drive motor is fitted to the shaft of the impression cylinder.

11. A web-fed rotary printing unit according to claim 1, wherein a drive train is arranged between the common drive motor and the impression cylinder.

12. A web-fed rotary printing unit according to claim 1, wherein an isolating clutch is provided between the impression cylinder and at least one of the further cylinders.

13. A web-fed rotary printing unit according to claim 1, wherein an isolating clutch is provided between the impression cylinder and the associated transfer cylinders of the first printing mechanisms.

14. A web-fed rotary printing unit according to claim 1, wherein an isolating clutch is provided between the transfer cylinders and the associated form cylinders of the first pair of printing mechanisms.

15. A web-fed rotary printing unit according to claim 1, wherein an isolating clutch is provided between the impression cylinder and at least one of the further cylinders connected through the drive connection with the common drive motor and wherein the at least one of the further cylinders is driveable by an auxiliary motor.

16. A web-fed rotary printing unit according to claim 15, wherein a further isolating clutch is provided between the auxiliary motor and the at least one of the further cylinders driven by the auxiliary motor.

17. A web-fed rotary printing unit according to claim 16, wherein at least one of the further cylinders is a form cylinder and the further isolating clutch is provided between the auxiliary motor and the form cylinder.

18. A web-fed rotary printing unit according to claim 1, wherein at least one of the first pair of printing mechanisms includes inking and/or damping units that are driveable via the form cylinder of the respective one of the pair of printing mechanisms.

19. A web-fed printing unit according to claim 18, wherein an isolating clutch is provided between the form cylinder and the associated inking and/or damping unit.

20. A web-fed rotary printing unit according to claim 18, further including an auxiliary motor that is capable of being coupled to the form cylinder or the associated inking and/or and damping unit by a changeover mechanism.

21. A web-fed rotary printing unit to claim 1, wherein the form cylinder of one of the first pair of printing mechanisms is rotatable by the common drive motor without rotation of the impression cylinder.

22. A web-fed rotary printing unit according to claim 1, wherein, to adjust the circumferential register of the printing unit, the form cylinder of one of the pair of printing mechanisms and the impression cylinder are rotatable by the common drive motor.

* * * * *